US006247990B1

(12) United States Patent
Moorhouse

(10) Patent No.: US 6,247,990 B1
(45) Date of Patent: Jun. 19, 2001

(54) HIGH PERFORMANCE RUBBERBAND LAUNCHED TOY AUTOGIRO WITH FOLD OUT WINGS

(76) Inventor: David Paul Moorhouse, 1608 Plantation Cir., Asheboro, NC (US) 27203-7053

( * ) Notice: Subject to any disclaimer, the term of this patent is extended or adjusted under 35 U.S.C. 154(b) by 0 days.

(21) Appl. No.: 09/422,766

(22) Filed: Oct. 22, 1999

(51) Int. Cl.[7] ..... A63H 27/14
(52) U.S. Cl. ..... 446/64; 446/63; 446/45
(58) Field of Search ..... 446/62, 63, 64, 446/45, 54, 65, 66, 67, 68; 473/578, 580

(56) References Cited

U.S. PATENT DOCUMENTS 2,236,877 * 4/1941 Jacobs ..... 446/62
2,417,267 * 3/1947 Porter ..... 446/62
4,836,817 * 6/1989 Corbin ..... 446/62
4,863,413 * 9/1989 Schwarz ..... 446/62
5,013,277 * 5/1991 Hufeld ..... 446/61
5,284,454 * 2/1994 Randolph ..... 446/62
5,423,706 * 6/1995 Chase ..... 446/62

* cited by examiner

*Primary Examiner*—Sam Rimell

(57) ABSTRACT

A new high performance rubberband launched toy autogiro is described. Using lightweight rigid materials, this device ascends at high velocity to over 100 feet, then unfolds its wings and begins a spinning slow-speed descent lasting 15 seconds or more. Minimal skill is needed to launch this toy, and depending on the force used to launch it, short or long times aloft can be achieved. Under thermal updraft conditions, descent time can extend to over a minute.

1 Claim, 2 Drawing Sheets

HIGH PERFORMANCE RUBBERBAND LAUNCHED TOY AUTOGIRO WITH FOLD OUT WINGS

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

My invention falls under the category of outdoor action toys such as hand/rubberband launched glider airplanes or hand twirled propellers (whirligigs). I have a vague recollection of seeing an all plastic toy with the same objective as my invention, but it was more of a novelty without the high performance features of my design. A few years ago I began the task of making a high performance toy autogiro like the one to be described, and after repeated failures, I realized the undertaking proved to be more difficult than I imagined. The reasons for the difficulty are primarily in the contradictory design requirements. To obtain a high altitude, the device must be streamlined. During descent it must have high wind drag. One attribute is usually achieved at the expense of the other. This is probably why only marginal performance has been seen to date. Making a device that will undergo such a transition is quite a challenge, especially for a toy. Without the right design such a toy could fail to transition properly, and damage results as I can attest. Also timers and sensors (altitude, attitude, velocity, inertia, etc.) for a toy are prohibitive due to complexity and cost. The invention I am submitting, through a unique blend of materials and design features solves the problems mentioned. Though appearing simple, this design is not obvious considering the many variables involved. I do not know of any previous invention with the high performance characteristics of the one described herein.

BRIEF SUMMARY OF THE INVENTION

A rubberband launched toy autogiro which due to its clean aerodynamic design and light weight can be propelled at high velocity to an altitude in excess of 100 feet. As wind drag and gravity bring the upward speed to zero, air pressure on the two folded wings drops and allows them to open. Gravity pulls the nose downward and the toy spins autogiro-like in a slow descent back to the ground. With a descent rate of about 8 to 10 ft/sec, time aloft can be routinely greater than 15 seconds. Under conditions of thermal air uplifts, it may stay aloft over one minute (and possibly get lost). Some skill is needed to launch it without entanglement in the rubberband, but with practice anyone 10 or more years old should have little difficulty, while those as young as four can catch it on landing. In a cleared open area under calm weather, this is a fascinating, high performance, flying outdoor toy which can be enjoyed by young and old.

DETAILED DESCRIPTION

Reference A shows the wooden body. Reference B shows one of the two plastic film hinges. Reference C shows the two polystyrene foam wings clamped together by the thumb and forefinger. Reference D shows the rubber band launcher.

Figure 1:
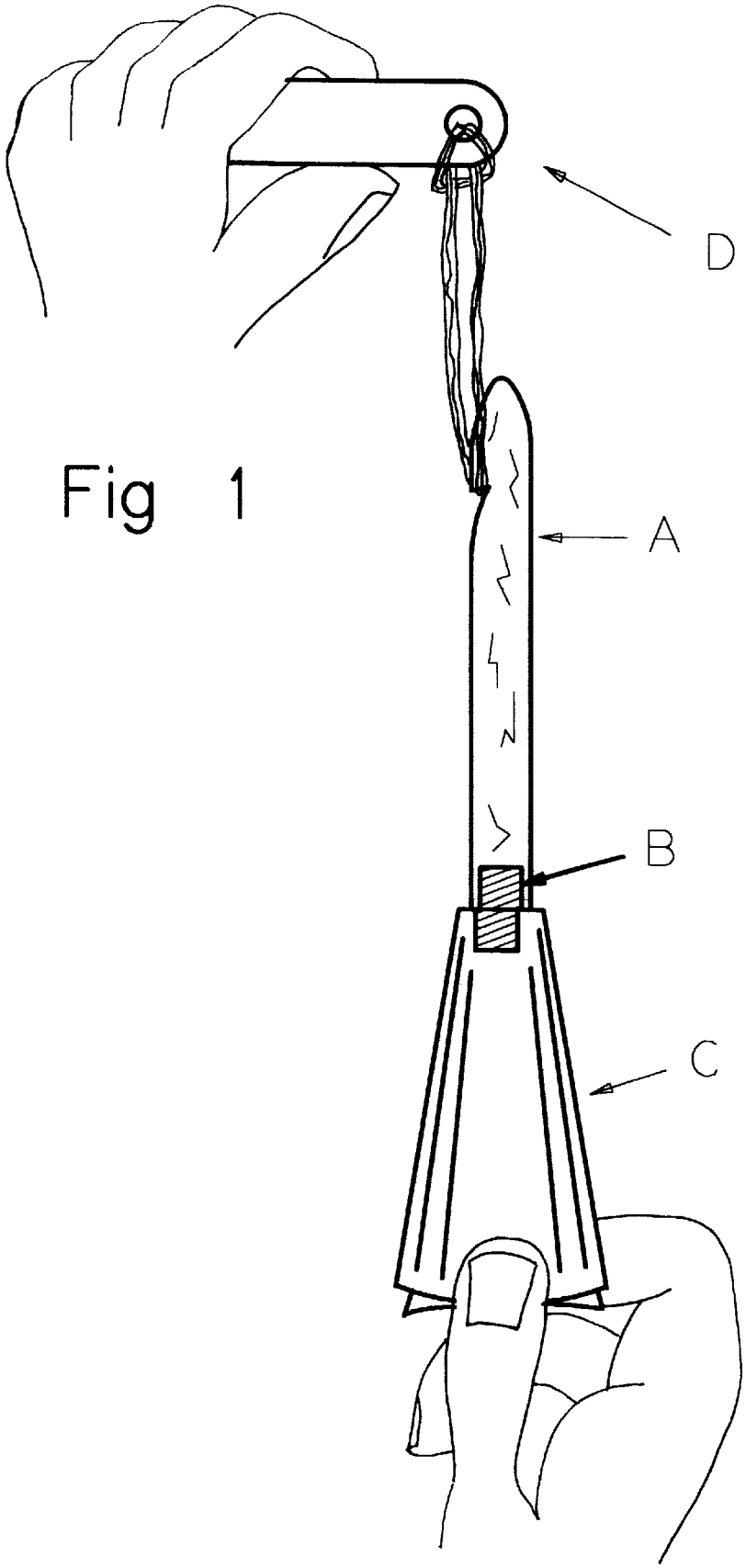
FIG. 1 shows the invention about to be launched and in ascent position.
Figure 2:
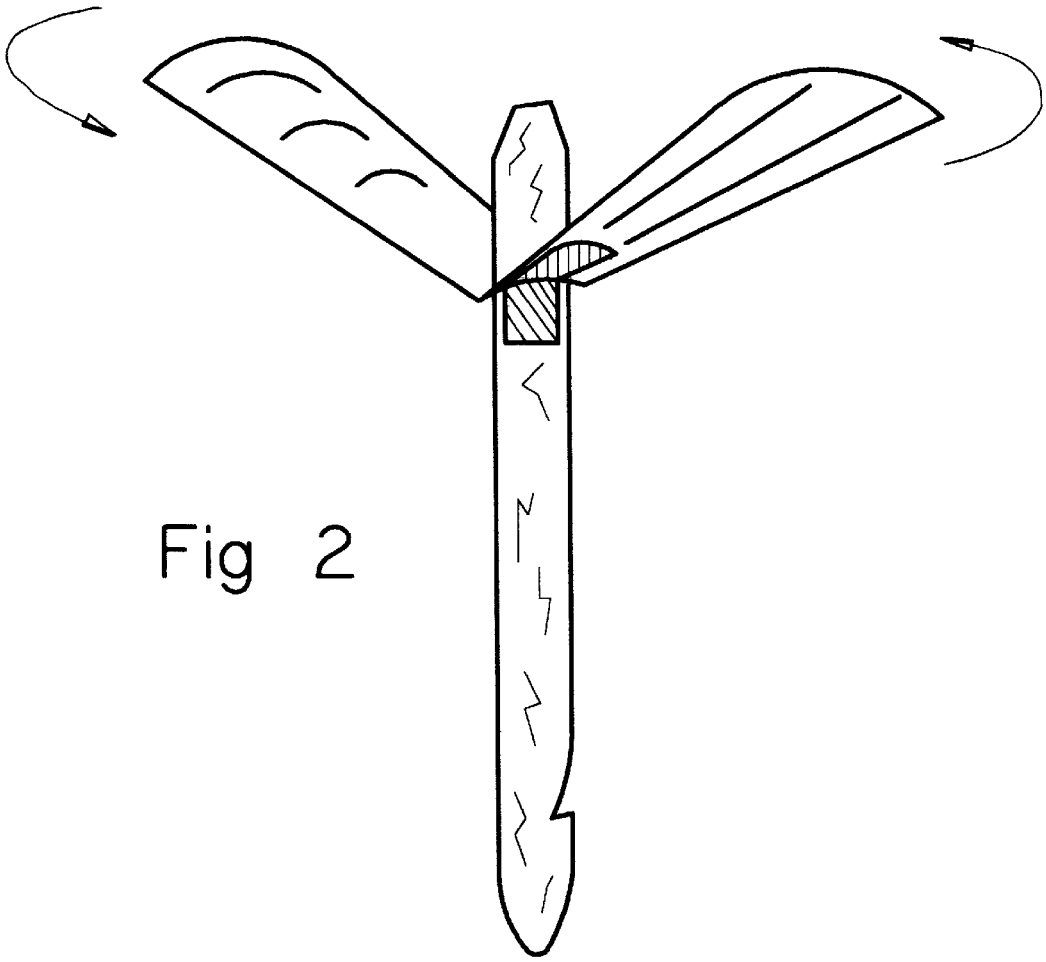
FIG. 2 Illustrates the invention spinning in descent with wings about 45 degrees from the horizontal. The creased plastic hinges are in their relaxed state.

My invention consists of a 1/16th inch thin wooden body 9/16 inch wide, 6 inches long and notched near the head to accommodate a heavy rubberband. The head is bluntly pointed to balance safety and streamlining. The tail end is tapered as well. Attached about one inch from the tail on both flat sides are two thin (1/32 inch) high-density polystyrene foam (Styrofoam) wings having a trapezoidal shape 3–5/8 inches long with the narrow 3/4 inch end attaching to the body and flared out to about 1–5/8 inches wide at the outer wing tip. The wings are curved (the outer wing tip follows the curvature of about a 3 inch diameter circle), and attached so the curve is upward on descent. Two plastic film hinges attach the wings to the body. Approximately 9/16 inch wide and 1–1/2 inches long, they are folded and creased into an "L" shape. Using double stick foam tape, One 3/4 inch leg of the "L" is attached to the body and the other to the wing as shown in FIG. 1. The tape grips the hinges securely to the wings and body. When relaxed the wings will stand off from the tail of the body by an angle of 45 to 90 degrees, due to the elastic memory in the creased hinges.

To assure a relatively straight ascent, my design uses the last tapered inch of the tail to force wing and body alignment. Also the wing curvature like feathers in a dart aids in keeping the trajectory straight. A high velocity, high altitude launch is obtained by lightweight, low profile cross sections of all components and the smooth transition afforded by the hinge connection of the body and the wing. The rigidity of the materials selected prevents instability as well.

When launched, the wings are folded back parallel to the body, and during ascent are kept back by the pressure of rapid air movement. Near the trajectory peak, the air pressure drops to a minimum and allows the small force in the elastic memory of the creased hinges to open the wings. As the nose points down, the toy aircraft shifts modes from a "dart" to an "autogyro" in a fraction of a second. No elaborate timing mechanisms are required to force this transition in my invention. After the transition each wing is in a 45 degree angle more or less from the vertical and visually creates a cone shape as the toy spins and slowly descends to the ground. The spin can be in either direction, and results from the inevitable asymmetry of the wing and attachment geometry as well as spiraling motion during ascent. Significant experimentation was required to prompt the simple, plastic film hinge solution to the problem of opening the wings. The approximately 1/2 in. width of the hinge is enough to keep the wings in proper orientation for fast ascent and autogiro descent, yet it allows some torsional flexibility to unfold quickly and then begin twirling. The wing curvature aids with wing unfolding and promotes lift in descent as well.

What is claimed is:

1. A toy autogyro system, comprising:

a thin rigid body having tapered first and second ends, first and second sides, and a mid section;

a cut-away notch portion located in a forward portion of said mid-section;

a pair of rigid wings having end portions hingeably attached to said first and second sides of said rigid body respectively, each of said rigid wings having a curved airfoil shaped cross section and tapering in a longitudinal direction along the length of said wing;

thin film hinges adhesively connecting each of said end portions of said rigid wings to each of said first and second sides of said rigid body, such that said hinges form an L-shape when said wings extend perpendicular to said body;

means for launching including a rubber band configured to connect with said notch portion so as to permit launching of said autogyro.

* * * * *